US005170846A

United States Patent [19]

Hope

[11] Patent Number: 5,170,846

[45] Date of Patent: Dec. 15, 1992

[54] SYSTEM AND APPARATUS FOR CONTROLLING A WELL

[76] Inventor: Alfred G. Hope, R.R. 1, Box 258, Superior, Wis. 54880

[21] Appl. No.: 698,952

[22] Filed: May 13, 1991

[51] Int. Cl.[5] ..... E21B 33/02; E21B 34/02; E21B 35/00

[52] U.S. Cl. ..... 166/379; 166/79; 166/93; 166/97

[58] Field of Search ..... 166/92, 93, 379, 79, 166/97

[56] References Cited

U.S. PATENT DOCUMENTS 1,170,851 2/1916 Savage ..... 166/93
1,511,205 10/1924 Leslie ..... 166/92
1,949,672 3/1934 Barrier ..... 166/93 X
1,978,377 10/1934 Walker ..... 166/92
3,693,715 9/1972 Brown ..... 166/93 X

*Primary Examiner*—Stephen J. Novosad
*Attorney, Agent, or Firm*—Jerold M. Forsberg

[57] ABSTRACT

A system utilizing an apparatus for controlling a gushing well comprises a vehicle having articulated components such as a boom and an arm with a carriage assembly at the end of the articulated arm. The system is adapted to transport and position the apparatus for installation on the well pipe casing. Once the apparatus has been installed on the gushing well the valves in the apparatus can be closed and the flow from the well stopped.

20 Claims, 4 Drawing Sheets

SYSTEM AND APPARATUS FOR CONTROLLING A WELL

BACKGROUND OF THE INVENTION

The present invention relates generally to a system and an apparatus for controlling a gushing well, and more specifically to a system including a vehicle having articulated components including a carriage adapted to transport and position a multi-part device having a valve included as a part thereof for mounting on a pipe casing of a gushing well.

The instant invention is generally related to the field of controlling the flow from gushing oil wells which may or may not be on fire. Most modern approaches to the problem have centered around stopping the flow without providing for the continued use of the well. Usually when a well is out of control the mechanism for controlling the flow from the well is either damaged or destroyed. Sometimes all that remains is a pipe casing projecting from the ground with oil and other materials gushing therefrom. In those instances where a mechanism controlling a well has been damaged and is still in place with the well gushing, the well pipe casing is cut off below the damaged mechanism to provide an exposed end of the pipe casing. It is a common approach to then try to insert a plug in the open end. When an oil well is on fire a number of varied approaches have been taken which include the use of explosive charges to attempt to blow the fire away from the well so that attempts can then be made to either cap or to plug the well. The least desirable of all approaches from a production stand point is the use of earth working equipment to fill in the well.

A search was done to review the patentability of the instant invention. The references found are discussed below, but their value, and in some cases their operability, is questioned. One device, disclosed in U.S. Pat. No. 1,874,889, shows a device carried by a carriage which is rolled over the end of a well and engaged such that the valve can be closed and the well controlled. Another device for controlling a gushing well, shown in U.S. Pat. No. 1,978,377, includes a pair of valves 14 and 15 pivoted relative to a collar mounted on the well pipe casing by an actuator rod permitting the operator to function at a distance from the well. A vehicle is shown bringing an apparatus for controlling a gushing well in U.S. Pat. No. 1,351,700. Another vehicle is shown in a Russian inventor's certificate dated Jun. 6, 1980 and numbered SU-938182. Another device shown installing a valve on a well is depicted in U.S. Pat. No. 1,803,945. And another device for controlling fluid around a joint between two pieces of well pipe casing is depicted in U.S. Pat. No. 2,522,444.

It is believed that none of the prior art devices and approaches to the controlling of a gushing oil well disclose or anticipate the system and apparatus as disclosed and claimed herein.

SUMMARY OF THE INVENTION

According to the present invention, a system utilizing an apparatus for controlling the flow from a gushing well includes a valve as a part thereof, a pair of pressure head portions hinged relative to one another, a flange and a collar portion on each of the pressure head portions with the flanges adapted to be secured to one another to form a chamber and the collar portions adapted to engage and seal around the pipe casing of the gushing well, and a vent interconnecting the chamber with the valve. The system includes a vehicle having articulated components such as a boom and an arm with a carriage assembly at the end of the articulated arm adapted to releasably engage and transport the apparatus for installation on the well pipe casing. Once the apparatus has been installed on the well the valves therein can be closed and the flow from the well is stopped.

Accordingly, it is an object of the present invention to provide a system for controlling a gushing well;

It is another object of the invention to provide a device which when installed on the well pipe casing controls the flow from the gushing well.

It is yet another object of the invention to provide a vehicle which has articulated portions and a carriage assembly that can be reused.

It is also an object of this invention to provide a device which, when mounted on .a well pipe casing will permit the well to be connected to equipment normally associated with an oil well.

Other objects and advantages of the present invention will be apparent and understood from the following detailed description when taken in conjunction with the accompanying drawings.

DETAILED DESCRIPTION OF THE PREFERRED EMBODIMENT

Figure 1:
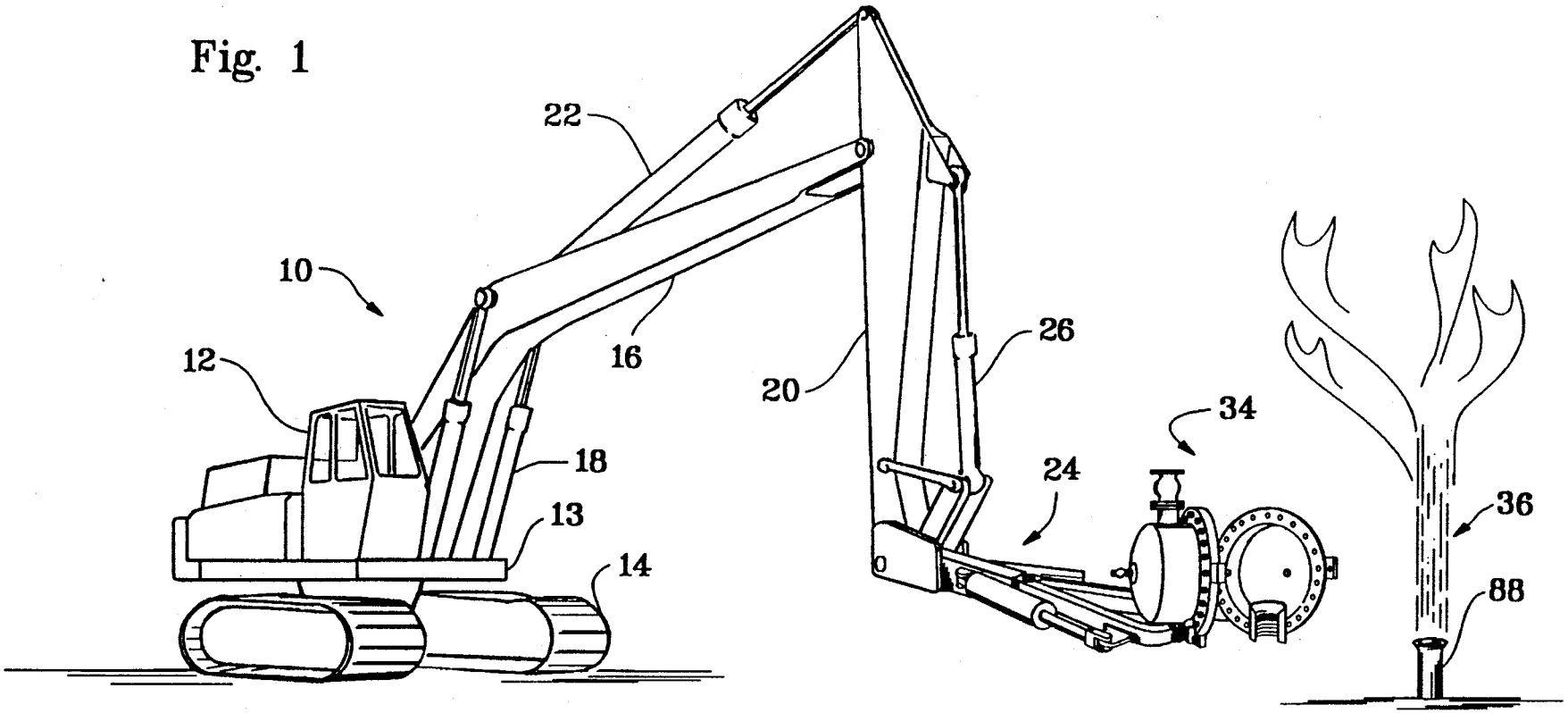
FIG. 1 is a perspective view of a vehicle transporting an apparatus for controlling flow from a gushing well approaching a gushing well.

Reference herein below is made to the drawings wherein like reference numerals have been employed to designate the same or similar components throughout the various views.

Referring now to FIG. 1, a vehicle 10 includes a cab 12 on a rotating platform 13 carried by endless tracks 14. The vehicle has articulated components including a boom 16 actuated by rams 18 and an arm 20 actuated by ram 22. Arm 20 carries a carriage 24 at the end thereof movable about a horizontal axis by ram 26. Carriage 24 includes a carriage beam 28 having a pair of carriage arms 30 pivotally attached at a distal end. Carriage arms 30 are pivoted relative to the end of carriage beam 28 independently of one another by rams 32. Carriage arms 30 support a multi-part device 34, specially designed for facilitating the mounting of a valve on a gushing oil well 36, for transportation and positioning of the device relative to the well.

Figure 5:
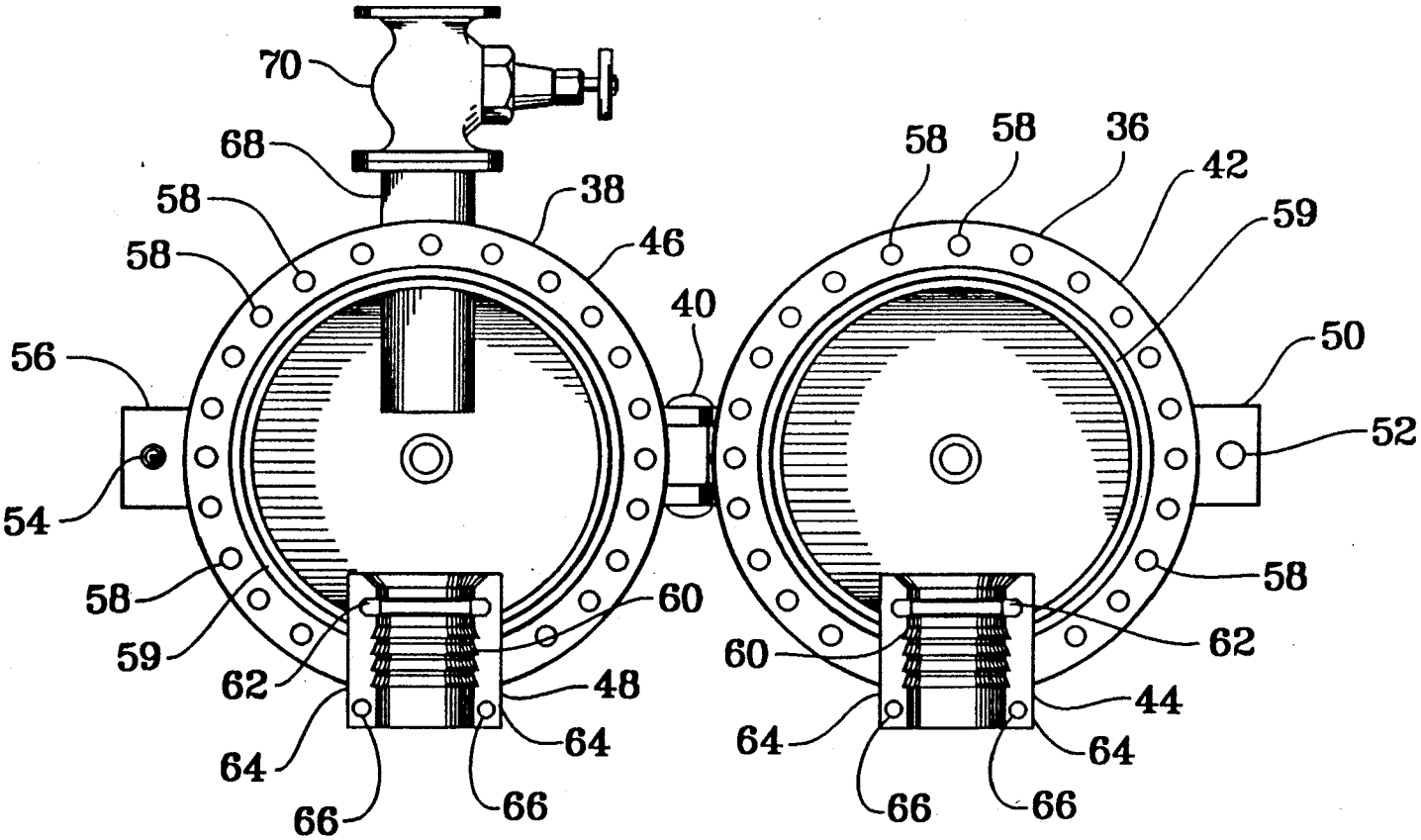
FIG. 5 is a view showing the apparatus in a fully opened condition.
Figure 6:
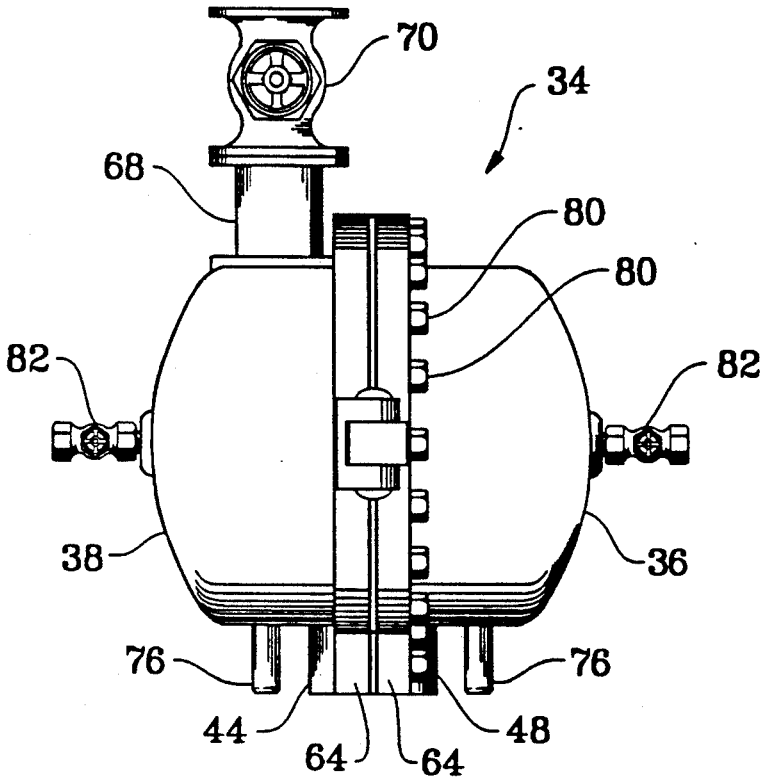
FIG. 6 is a view of the apparatus in the closed condition.

Referring now to FIGS. 5–6, the apparatus depicted as a multi-part device 34 includes a pair of pressure head portions 36 and 38 hinged relative to one another by hinge 40. Pressure head portion 36 includes a flange 42 and a collar portion 44 and pressure head portion 38 includes a flange 46 and a collar portion 48. Flanges 42 and 46 are for the purpose of securing the pressure head portions 36 and 38 and collar portions 44 and 48 relative to one another and for reinforcing the entire arrangement. Pressure head portion 36 includes a guide plate 50 having an aperture 52 of a predetermined size therein for receiving a guide pin 54 extending outwardly from guide plate 56 on pressure head portion 38. Flanges 42 and 46 have a plurality of apertures 58 evenly spaced around the perimeter of each respective pressure head portion such that the apertures are aligned in pairs when the flanges are juxtaposed. One or both of the flanges 42 and 46 include a ring joint seal 59. The collar portions 44 and 48 include serrations 60, and a portion of a ring joint seal 62, the reasons for which will be more clearly understood later. Each collar portion includes flanges 64 having bolt receiving apertures 66 therein. Pressure head portions 36 and 38 are mirror images of one another except for the guide pin 54 and aperture 52 and vent 68 to which is mounted valve 70.

Figure 7:
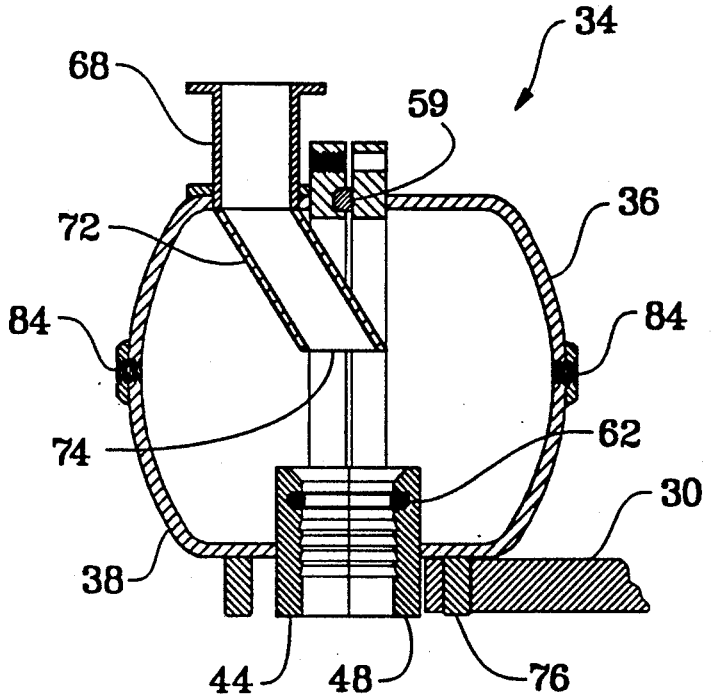
FIG. 7 is a cross sectional view of the apparatus as shown in FIG. 6.

As best seen in FIGS. 6 and 7, vent 68 extends into a chamber formed by the pressure head portions and includes an angled section 72 which has an open end 74 generally aligned with a central axis of an inlet formed by collar portions 44 and 48. Multi-part device 34 includes depending pins 76 engageable by apertures 78 in the ends of carriage arms 30 (see FIG. 7). Pressure head portions 36 and 38 form a sealed chamber when flanges 42 and 46 are fastened together by bolts 80. The need for a nut being used with each bolt 80 can be obviated by the apertures in one of the flanges being threaded. As seen in FIG. 6, each of the pressure head portions includes a centrally disposed valve 82 and in the alternative, as seen in FIG. 7, includes a centrally disposed access 84.

Figure 4:
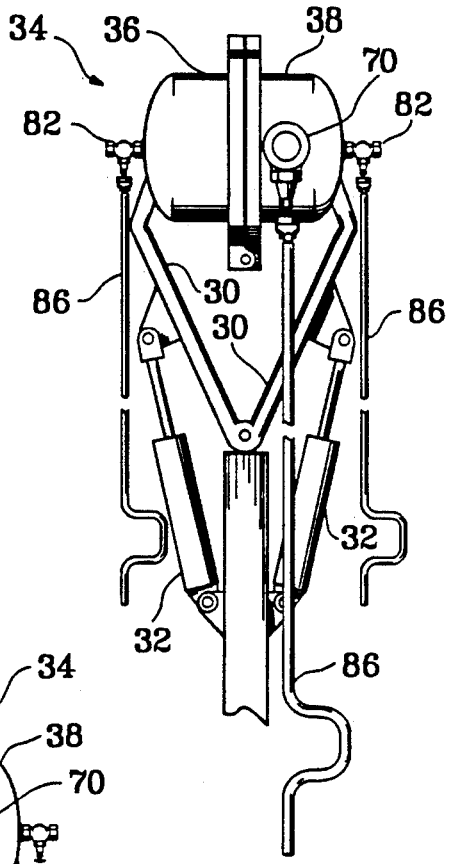
FIG. 4 is a view similar to FIG. 3 with the other pressure head portion pivoted into position on the well pipe casing.

Referring now to FIG. 4, valve 70, which is preferably a gate valve, and valves 82 are each provided with an actuating rod 86, appropriately sized, for opening and closing the valves from a distance. Each actuating rod is releasably attached to a respective valve and includes a universal coupling (not shown in detail).

Figure 2:
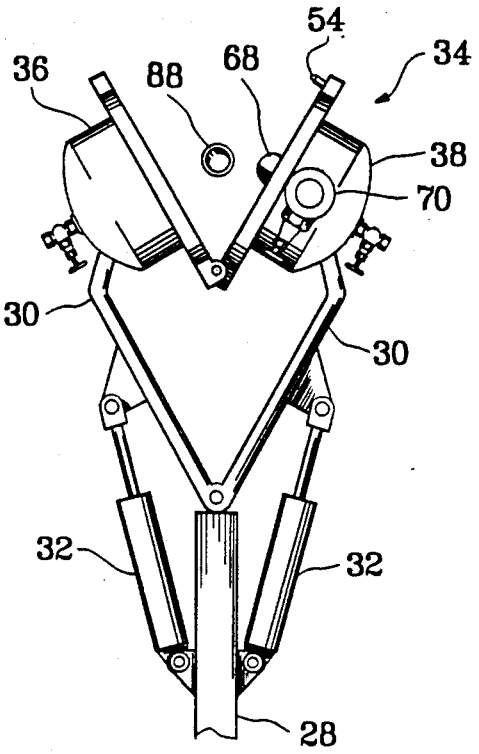
FIG. 2 is a partial view looking down at the carriage assembly just prior to the positioning of the apparatus.
Figure 3:
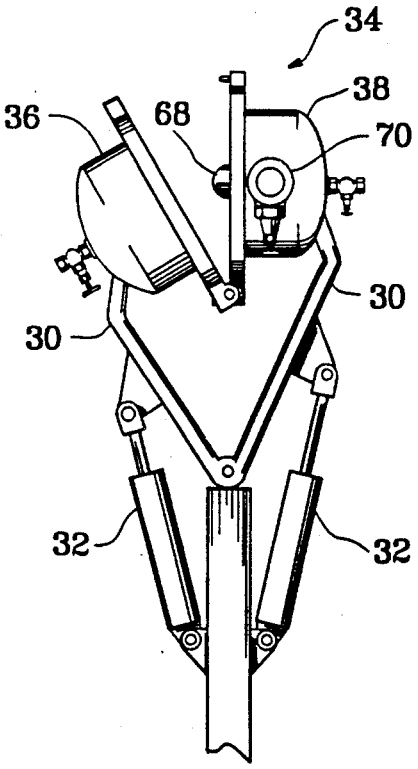
FIG. 3 is a view similar to FIG. 2 with one pressure head portion having been brought into position on the well pipe casing.

In operation, vehicle 10 carries the multi-part device 34 to a gushing well 36 having a pipe casing 88 protruding from the ground. Vehicle 10 can reach substantial distances because of the articulation ability of boom 16 and arm 20 in conjunction with carriage 24. Upon reaching pipe casing 88 the multi-part device is positioned so as to have one of the pressure head portions on each side thereof (see FIG. 2). Pressure head portion 38 is then positioned such that collar portion 44 is in engagement with well pipe casing 88. This is accomplished by movement of the vehicle, articulation of the boom and arm and actuation of ram 32 in conjunction with carriage arm 30. Once pressure head portion 38 is in position, the platform 13 can be set to free wheel relative to the traction unit and then pressure head portion 36 can be pivoted such that collar portion 48 engages well pipe casing 88 with flanges 42 and 46 being juxtaposed. As the pressure head portions are pivoted together guide pin 54 ensures a proper alignment and sealing thereof. During the positioning of pressure head portion 38 the inlet end 74 of vent 68 will be brought into alignment with the material gushing from the well such that, in the position depicted in FIG. 3, the material will begin flowing through the vent and attached valve 70. Rams 32 actuating the pivoting of carriage arms 30 ideally are capable of exerting 70,000 psi of force each. Thus, in the stage of installation depicted in FIG. 4 the collar portions can be squeezed around the pipe casing with sufficient force to engage the serrations 60 and bring the flanges 42 and 46 together such that the ring joint seal 59 ensures that a sealed chamber is formed by the pressure head portions. In the preferred configuration the multi-part device includes valves 82 which are open during installation to permit air flow or the escape of material from the well as needed. At this point, if need be, the flow through the multi-part device can be controlled, in the preferred arrangement, by first closing valve 70 and then closing valves 82. This can be accomplished by utilizing actuator rods 86 which can be elongated to any desired length which will permit the operator to be at a safe distance from the well. Preferably bolts are engaged in apertures 58 and 66 to securely fasten the multi-part device relative to the well pipe casing prior to the disengagement and removal of vehicle 10 from the area. It is contemplated that an ignitor may be beneficial when a flowing well may need to be reignited after a control device as described herein has been installed. Such a device can be of various known forms and positioned where effective.

While this invention has been described with a certain degree of particularity, it is manifest that many changes may be made in the details of construction and in the arrangement of components without departing from the spirit and scope of the disclosure. It is understood that the invention is not limited to the embodiment set forth herein for purposes of exemplification, but is limited only by the scope of the attached claims, including the full range of equivalency to which each element thereof is entitled.

I claim:

1. A multi-part device facilitating the mounting of a valve means on a pipe casing of a gushing well, the device including a pair of pressure head portions each having a flange and a mounting collar portion, means for fastening said flanges to one another, and vent means controlled by said valve means, said mounting collar portions including means for engaging said pipe casing to fixedly secure the device relative thereto when said flanges are secured to one another, said pressure head portions cooperating when said flanges are secured to one another to form a chamber having an inlet defined by said mounting collar portions, said vent means communicating with said chamber wherein the gushing well is permitted to flow through the chamber and vent means until the multi-part device is fixedly secured to the well pipe casing by the collar portions whereinafter the valve means controls the flow from the well, said valve means including a gate valve mounted on said vent means and said vent means extends into the chamber and includes an open end which is generally aligned with the well pipe casing when the multi-part device is mounted thereon.

2. A multi-part device facilitating the mounting of a valve means on a pipe casing of a gushing well, the device including a pair of pressure head portions each having a flange and a mounting collar portion, means for fastening said flanges to one another, and vent means controlled by said valve means, said mounting collar portions including means for engaging said pipe casing to fixedly secure the device relative thereto when said flanges are secured to one another, said pressure head portions cooperating when said flanges are secured to one another to form a chamber having an inlet defined by said mounting collar portions, said vent means communicating with said chamber wherein the gushing well is permitted to flow through the chamber and vent means until the multi-part device is fixedly secured to the well pipe casing by the collar portions whereinafter the valve means controls the flow from the well, said flanges including bolt receiving apertures whereby bolts can be used to secure the flanges together.

3. A device as set forth in claim 2 wherein a seal is included on at least one of the flanges and each collar portion includes a seal for sealing around the pipe casing such that when the flanges are bolted together a sealed chamber is formed.

4. A device as set forth in claim 3 wherein the sealed chamber is reinforced around the vent means and around the collar portions.

5. A device as set forth in claim 3 wherein said pressure head portions form a generally cylindrical sealed chamber with domed ends.

6. A device as set forth in claim 3 wherein the pressure head portions are generally of one of ASME spherical, ellipsoidal, and hemispherical pressure head configurations.

7. A device as set forth in claim 3 wherein a hinge means hinges the pressure head portions relative to one another permitting handling of the multi-part device as a single unit.

8. A device as set forth in claim 7 wherein each of the pressure head portions includes a bracket adapted for engagement by equipment used to position the device relative to the well pipe casing.

9. A device as set forth in claim 7 wherein each of the pressure head portions includes an access fitting centrally disposed therein.

10. A device as set forth in claim 7 wherein each of the pressure head portions includes a valve centrally disposed therein.

11. A device as set forth in claim 10 wherein an actuator rod is provided for each valve and an actuator rod is provided for said valve means whereby the valves and the valve means can be opened and closed by an operator positioned at a predetermined distance from the device.

12. A multi-part device facilitating the mounting of a valve means on a pipe casing of a gushing well, the device including a pair of pressure head portions each having a flange and a mounting collar portion, means for fastening said flanges to one another, and vent means controlled by said valve means, said mounting collar portions including means for engaging said pipe casing to fixedly secure the device relative thereto when said flanges are secured to one another, said pressure head portions cooperating when said flanges are secured to one another to form a chamber having an inlet defined by said mounting collar portions, said vent means communicating with said chamber wherein the gushing well is permitted to flow through the chamber and vent means until the multi-part device is fixedly secured to the well pipe casing by the collar portions whereinafter the valve means controls the flow from the well, said collar portions including flanges which include apertures for receiving bolts.

13. A method for controlling a gushing well including the steps of:

positioning one part of a multi-part device proximate an end of a pipe casing of the well;

aligning an end of a vent means extending inside of a chamber portion of said one part with an open end of the well pipe casing to collect material gushing therefrom such that flow from the well passes through the vent means;

pivoting another part of the multi-part device to thereby form a chamber having an inlet formed by collar portions encircling said pipe casing;

fastening the multi-part device together with fasteners such that equipment used for installation of the device can be removed; and actuating a valve in said vent means to control flow from the well.

14. A method as set forth in claim 13 wherein the step of fastening includes bolting the pivoted parts together such that collar portions fixedly secure the multi-part device in position on the well pipe casing.

15. A method as set forth in claim 13 including the step of providing brackets on the device for engagement by equipment used to position the device for installation.

16. A method as set forth in claim 13 wherein the method includes the step of venting the chamber to permit air intake into the enclosed chamber prior to the shutting off of the valve means and after installation of the multi-part device on the pipe casing the valve is closed and the vents are closed thereby controlling flow from the well.

17. A system for controlling a gushing well comprising a device having a valve means as a part thereof and a self-propelled vehicle for transporting and positioning the device relative to a pipe casing of the well, said device including pressure head portions hinged relative to one another, vent means interconnecting a pressure head portion and the valve means, a collar portion on each respective pressure head portion, and means for securing said collar portions relative to said pipe casing, said self-propelled vehicle including articulated means and carriage means, said carriage means being adapted to releasably engage and transport said device and cooperate with said vehicle and said articulated means to position said collar portions proximate said pipe casing wherein said collar portions form an inlet for a chamber formed by said pressure head portions when said collar portions are secured around said pipe casing whereby when said device is fixedly secured to said pipe casing said well is controlled by said valve means.

18. A system as set forth in claim 17 wherein said pressure head portions include flanges which are juxtaposed when said collar portions are secured around said pipe casing, said collar portions including means for gripping said pipe casing, and fastener means for fastening said flanges, to one another.

19. A system as set forth in claim 18 wherein said device includes bracket means releasably engagable by said carriage means such that after said fastener means is introduced said carriage means can be released from said device and the vehicle moved away from the well.

20. A system as set forth in claim 17 wherein said device includes a valve centrally located on each pressure head portion, an elongated actuator rod for the valve on each pressure head portion and an elongated actuator rod for the valve means whereby the valves and the valve means can be opened and closed by an operator positioned at a predetermined distance from the device.

* * * * *